US007845760B2

(12) United States Patent
Hirakawa

(10) Patent No.: US 7,845,760 B2
(45) Date of Patent: Dec. 7, 2010

(54) IMAGE FORMING APPARATUS

(75) Inventor: Takashi Hirakawa, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 909 days.

(21) Appl. No.: 11/729,770

(22) Filed: Mar. 30, 2007

(65) Prior Publication Data

US 2007/0229586 A1 Oct. 4, 2007

(30) Foreign Application Priority Data

Mar. 31, 2006 (JP) ..... 2006-100460

(51) Int. Cl.
*B41J 2/165* (2006.01)

(52) U.S. Cl. ..... 347/31; 347/30

(58) Field of Classification Search ..... 347/30–32, 347/103

See application file for complete search history.

(56) References Cited

U.S. PATENT DOCUMENTS 4,990,962 A * 2/1991 Kishi ..... 399/233
5,365,261 A * 11/1994 Ozawa et al. ..... 347/103
5,589,865 A * 12/1996 Beeson ..... 347/28
5,640,655 A * 6/1997 Shoji ..... 399/249
5,758,237 A * 5/1998 Abramsohn ..... 399/249
5,841,456 A * 11/1998 Takei et al. ..... 347/103
5,873,014 A 2/1999 Knapp et al.
6,719,423 B2 * 4/2004 Chowdry et al. ..... 347/103
7,334,862 B2 * 2/2008 Kachi ..... 347/22
7,455,384 B2 * 11/2008 Tezuka ..... 347/23
7,458,672 B2 * 12/2008 Hirakawa ..... 347/101
7,506,974 B2 * 3/2009 Hirakawa ..... 347/101
7,527,369 B2 * 5/2009 Hirakawa ..... 347/100
7,533,983 B2 * 5/2009 Hirakawa ..... 347/102
7,604,319 B2 * 10/2009 Hirakawa ..... 347/21
7,645,019 B2 * 1/2010 Hirakawa ..... 347/21
7,726,802 B2 * 6/2010 Morimoto ..... 347/100
2003/0067529 A1 4/2003 May et al.
2004/0070656 A1 4/2004 May et al.

FOREIGN PATENT DOCUMENTS

JP 6-47911 A 2/1994
JP 9-15981 A 1/1997
JP 11-249445 A 9/1999
JP 2003-182064 A 7/2003

* cited by examiner

*Primary Examiner*—Charlie Peng
(74) *Attorney, Agent, or Firm*—Birch, Stewart, Kolasch & Birch, LLP

(57) ABSTRACT

The image forming apparatus for applying a liquid on a medium to form an image, includes: a liquid absorbing member which absorbs at least a portion of the liquid applied on the medium; and a liquid recovery device which suctions and recovers the liquid absorbed in the liquid absorbing member while being in contact with the liquid absorbing member.

10 Claims, 11 Drawing Sheets

IMAGE FORMING APPARATUS

BACKGROUND OF THE INVENTION

1. Field of the Invention

The present invention relates to an image forming apparatus, and more particularly, to an image forming apparatus having a mechanism for recovering a solvent from a solution containing coloring material that has been ejected onto a recording medium or onto the surface of an intermediate transfer medium.

2. Description of the Related Art

One type of image forming apparatus known in the related art is an inkjet recording apparatus (inkjet printer) having an ink ejection head (inkjet head) in which a plurality of nozzles are arranged. An inkjet recording apparatus of this kind forms an image by ejecting ink from the nozzles in the form of liquid droplets, thereby forming dots on a recording medium, or thereby forming dots on an intermediate transfer body and subsequently transferring it to a recording medium, while the inkjet head and the recording medium or the intermediate transfer body are caused to move relatively with respect to each other.

Various methods are known conventionally as ink ejection methods for an inkjet recording apparatus of this kind. For example, one known method is a piezoelectric method where the volume of a pressure chamber is changed by causing a diaphragm forming a portion of the pressure chamber to deform due to deformation of a piezoelectric element. In this case, ink is introduced into the pressure chamber from an ink supply passage when the volume is increased, and the ink inside the pressure chamber is ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an image forming apparatus including an ink ejection head, such as an inkjet recording apparatus, ink is supplied to the ink ejection head from an ink tank which stores ink, via an ink supply channel, and the ink is ejected by one of various methods as described above; however, depending on the type of ink and the type of recording medium or the type of intermediate transfer body, the ink dots (liquid ink droplets) may bleed or blurring of the image may occur due to disruption of the dot shapes after landing of the droplets onto the recording medium, and when a color image is recorded by using inks of a plurality of different colors, bleeding between the different colors and color mixing may occur if ink of one color is recorded in an overlapping fashion onto previously recorded ink of a different color which has not yet dried. This leads to deterioration of image quality.

In order to raise the speed of image recording and improve the quality of the recorded image, it is desirable that the ink solvent should be removed rapidly so that the ink dries quickly. Therefore, in the related art, various technologies have been proposed for removing the ink solvent rapidly so that the ink is caused to dry quickly.

For example, Japanese Patent Application Publication No. 6-47911 discloses a technology in which a recording medium on which a magnetic fluid (liquid) has been deposited is conveyed to a liquid absorbing roller. Upon making contact with the roller, the undried magnetic fluid (liquid) is absorbed by, and confined inside, a temperature-sensitive high-liquid-absorbing resin put onto the periphery of the roller. When recording is not being carried out, the temperature-sensitive high-liquid-absorbing resin is heated to raise the temperature of the resin, whereby the liquid retained inside the resin is discharged and recovered.

Furthermore, for example, Japanese Patent Application Publication No. 2003-182064 discloses a technology in which surplus liquid (solvent) is absorbed by making an auxiliary rotating member (made, for example, of a material such as a sponge roller) provided with a porous, soft and absorbent absorbing layer, or an open cell foam material, come into contact with an intermediate transfer body, whereupon a blade is pressed against the auxiliary rotating member, thereby squeezing out liquid from the auxiliary rotating member. The liquid thus squeezed out is collected in a container and thereby recovered.

Moreover, for example, Japanese Patent Application Publication No. 11-249445 discloses a technology in which a porous roller is placed in contact with a liquid image on a belt, excess liquid is absorbed from the surface of the image via holes and perforations in a skin coating section on the porous main body of the roller, and the liquid is suctioned into a central cavity via the roller skin, by a vacuum source. Moreover, in order to constantly remove the liquid from the developed image on the belt, a vacuum which produces both the negative pressure and positive pressure is generated by a vacuum source and the suctioned excess liquid is expelled to the exterior.

Furthermore, Japanese Patent Application Publication No. 9-15981 discloses an excess developer liquid removal apparatus comprising a liquid absorbing body which removes an excess developing liquid deposited on an image carrier after wet developing of an electrostatic latent image formed on the image carrier. The liquid absorbing body includes at least a surface layer which has air permeability and is made of a material with a surface energy of 25 $mJ/m^2$ or less, and an elastic porous layer formed to the lower layer side of this surface layer. The surface layer forms the outermost layer of the liquid absorbing body that is disposed in the vicinity of, or in contact with, the image carrier.

However, in the technology described in Japanese Patent Application Publication No. 6-47911, it is necessary to recover the liquid absorbed by the temperature-sensitive high-liquid-absorbing resin while the apparatus is not operating, and therefore, if the temperature-sensitive high-liquid absorbing resin has become full with the absorbed liquid during the image recording, then it is necessary to interrupt the image recording in order to recover the absorbed liquid, thus leading to a decline in productivity.

Moreover, in the technology described in Japanese Patent Application Publication No. 2003-182064, a blade-like member is pressed against an auxiliary rotating member made of a material such as a sponge roller, in such a manner that the solvent absorbed by the auxiliary rotating member is expelled and recovered. Since the blade, or the like, applies an external force to a member that is soft, such as a sponge roller, then there is a possibility of deterioration and breakage of the sponge roller and other such members.

Moreover, in the technology described in Japanese Patent Application Publication No. 11-249445, air flows into the porous body in all four directions when the liquid is suctioned from the interior of the porous roller. Therefore, it is difficult to perform suctioning unless the porous body is filled with liquid, and if there is liquid only inside a portion of the porous body, then it is difficult to recover this liquid. Furthermore, in the apparatus disclosed in Japanese Patent Application Publication No. 11-249445, the suctioning force of the porous body is adjusted in order to prevent toner particles from being suctioned into the porous body. If the suctioning force applied to the porous body is too weak, then the absorption speed declines and productivity becomes worse.

Moreover, in the technology described in Japanese Patent Application Publication No. 9-15981, the surface energy is set to be equal to or less than 25 $mJ/m^2$; however, this generally implies a hydrophobic surface and therefore is not suitable for absorbing a solvent whose principal component is water. Furthermore, if the coloring material has aggregated in the solvent, then the coloring material is liable to adhere directly to the surface because the surface is hydrophobic and the coloring material has increased affinity with the hydrophobic surface. Ultimately, it becomes a matter of which material (i.e., the surface where the coloring material is located, or the liquid absorbing body which has a surface energy equal to or less than 25 $mJ/m^2$) has the higher affinity with the coloring material. Therefore, the extent of adherence of the coloring material cannot be determined solely on the basis of the surface energy of the liquid absorbing body alone, and hence it is necessary to establish a relative relationship between the magnitude of the surface energy of the liquid absorbing body and the magnitude of the surface energy of the surface where the coloring material is located.

SUMMARY OF THE INVENTION

The present invention is contrived in view of the aforementioned circumstances, an object thereof being to provide an image forming apparatus which enables liquid to be recovered from a liquid absorbing member without damaging the liquid absorbing member even in a state where it has absorbed liquid partially, and which can reduce the adherence of coloring material and absorb only the solvent in a case where the liquid is a solvent containing coloring material.

The present invention is directed to an image forming apparatus for applying a liquid on a medium to form an image, comprising: a liquid absorbing member which absorbs at least a portion of the liquid applied on the medium; and a liquid recovery device which suctions and recovers the liquid absorbed in the liquid absorbing member while being in contact with the liquid absorbing member.

In this aspect of the present invention, it is possible to recover the liquid without causing damage to the liquid absorbing member, even in a state where a portion of the liquid is absorbed.

Preferably, the liquid recovery device includes a suction opening section through which the liquid absorbed in the liquid absorbing member is suctioned while the liquid recovery device is in contact with the liquid absorbing member; and the suction opening section has a length shorter than the liquid absorbing member in terms of a lengthwise direction of the liquid absorbing member, and is movable in the lengthwise direction of the liquid absorbing member.

In this aspect of the present invention, by moving the opening in accordance with the image region that has been recorded, it is possible to recover the liquid efficiently.

Preferably, the liquid recovery device includes a plurality of suction openings through which the liquid absorbed in the liquid absorbing member is suctioned while the liquid recovery device is in contact with the liquid absorbing member, and which are arranged in a lengthwise direction of the liquid absorbing member.

In this aspect of the present invention, by selectively operating the opening located at a position corresponding to the image region that has been recorded, it is possible to recover the liquid efficiently.

Preferably, the medium is a recording medium.

Preferably, the medium is an intermediate transfer medium.

Preferably, the liquid absorbing member has a surface energy greater than a surface energy of the intermediate transfer medium.

In this aspect of the present invention, in cases where the liquid is a solvent containing a coloring material, it is possible to recover the solvent alone while the adherence of the coloring material is suppressed.

Preferably, the liquid absorbing member includes an internal part and an exterior part which forms an exterior surface and has a surface energy greater than a surface energy of the internal part.

In this aspect of the present invention, in cases where the liquid is a solvent containing a coloring material, it is possible to recover the surplus solvent more reliably while the effects of suppressing the adherence of the coloring material is maintained.

Preferably, the liquid recovery device suctions and recovers the liquid absorbed in the liquid absorbing member, after a prescribed amount of the liquid is given to the liquid absorbing member.

In this aspect of the present invention, in cases where the liquid absorbing member has a porous structure, it is possible to recover the liquid efficiently without suctioning air unnecessarily when the liquid is recovered by means of a pump.

Preferably, the liquid recovery device suctions and recovers the liquid absorbed in the liquid absorbing member in such a manner that a prescribed amount of the liquid is left on the liquid absorbing member.

In this aspect of the present invention, in cases where the liquid absorbing member has a porous structure, it is possible to recover the liquid efficiently when the liquid is recovered by means of a pump.

Preferably, the liquid absorbing member is withdrawn from a position for absorbing the liquid applied on the medium when the liquid recovery device suctions and recovers the liquid absorbed in the liquid absorbing member.

In this aspect of the present invention, it is possible to recover the liquid without imparting an excessive load on the liquid absorbing member during recovery of the liquid.

As described above, according to the present invention, it is possible to recover the liquid without causing damage to the liquid absorbing member, even in a state where a portion of the liquid is absorbed. Furthermore, in cases where the surface energy of the liquid absorbing member is made to be greater than the surface energy of the intermediate transfer medium, or in cases where the surface energy of the surface of the liquid absorbing member is made to be greater than the surface energy of the interior of the liquid absorbing member, it is possible to prevent the adherence of the coloring material in the process of suctioning the solvent even if the liquid is the solvent mixed with the coloring material.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The image forming apparatus according to an embodiment of the present invention is an inkjet recording apparatus based on reaction of two liquids in which the coloring material in an ink is insolubilized by means of the two-liquid reaction between a treatment liquid and the ink. This image forming apparatus comprises a solvent removal member which removes at least a portion of the solvent from a recording medium or intermediate transfer medium which has received printing, and a solvent recovery mechanism which recovers the solvent externally from the solvent removal member.

Figure 1:
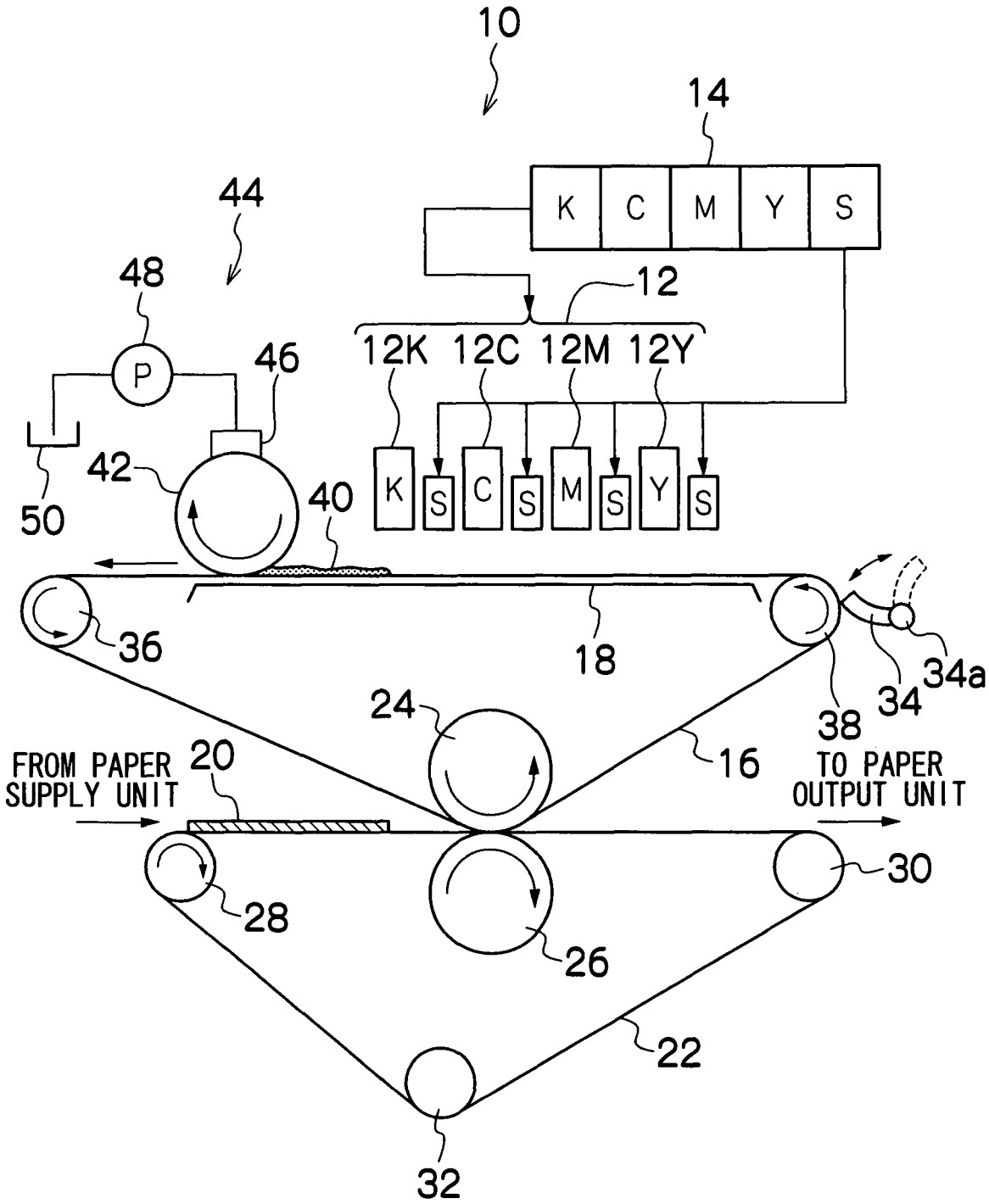
FIG. 1 is a general schematic drawing showing an inkjet recording apparatus which forms an image forming apparatus relating to a first embodiment of the present invention.

FIG. 1 is a general schematic drawing showing an inkjet recording apparatus which forms an image forming apparatus relating to a first embodiment of the present invention.

As shown in FIG. 1, this inkjet recording apparatus 10 is a two-liquid reaction type inkjet printer which prevents landing interference between inks, and the bleeding of ink due to the mixing of the transparent treatment liquid and ink which may cause the ink to solidify, or the like. The inkjet recording apparatus 10 has a print unit 12 comprising a plurality of print heads (ink application devices) 12K, 12C, 12M and 12Y provided respectively for ink colors and treatment liquid ejection heads (treatment liquid application devices) 12S disposed respectively immediately before the print heads 12K, 12C, 12M and 12Y.

In the embodiment shown in FIG. 1, the treatment liquid ejection heads 12S are provided respectively for print heads 12K, 12C, 12M and 12Y However, rather than providing a plurality of treatment liquid ejection heads 12S in this way, it is also possible to provide only one treatment liquid ejection head 12S, before all of the print heads 12K, 12C, 12M and 12Y.

Furthermore, the inkjet recording apparatus 10 also comprises: an ink storing and loading unit 14 which stores the inks to be supplied to the print head 12K, 12C, 12M and 12Y, and the treatment liquid to be supplied to the treatment liquid ejection heads 12S; an endless transfer belt 16 which forms an intermediate transfer medium; a guide plate 18 which supports the transfer belt 16 from below in such a manner that the transfer belt 16 is conveyed while being kept in a flat state below the print unit 12; an endless conveyance belt 22 which conveys the recording paper 20 supplied from a paper supply unit (not illustrated); a first transfer roller 24 and a second transfer roller 26 for transferring an image formed on the transfer belt 16 by making pressure contact from either side of the endless conveyance belt 22 conveying recording paper 20 supplied from the paper supply unit (not illustrated), the recording paper 20 and the transfer belt 16; a drive roller 28, an idle roller 30 and a tension roller 32, for driving the conveyance belt 22; and a cleaning blade 34 which cleans the transfer belt 16 after the image has been transferred to the recording paper 20; and the like.

The endless transfer belt 16 forming an intermediate transfer medium is spanned about rollers 36 and 38, and the first transfer roller 24. A guide plate 18 for keeping the transfer belt 16 flat in the portion between the roller 36 and the roller 38 is disposed to the lower side of the transfer belt 16. By attaching a heating device to the guide plate 18 and heating the transfer belt 16 from below, it is possible to cause the ink solvent to evaporate in such a manner that the ink solvent ejected onto the transfer belt 16 is removed.

Above the transfer belt 16 which is kept flat by the guide plate 18 in this way, the print heads 12Y, 12M, 12C and 12K of the respective colors are disposed in an aligned fashion, from the upstream side in terms of the conveyance direction of the transfer belt 16, and the treatment liquid ejection heads 12S are disposed immediately before the print heads 12Y, 12M, 12C and 12K, respectively.

When the transfer belt 16 passes below the print heads 12Y, 12M, 12C and 12K, firstly, the treatment liquid is ejected onto the region where an image is to be formed on the transfer belt 16, from each treatment liquid ejection head 12S disposed immediately before each of the print heads 12Y, 12M, 12C and 12K for each color. When the ink of each color is then ejected from the corresponding print head 12Y, 12M, 12C, 12K, the ink and the treatment liquid mix together, an aggregation reaction of the coloring material in the ink is produced, and the coloring material becomes insoluble. In this way, an image is formed on the transfer belt 16.

In this case, if the guide plate 18 is provided with a heating device, for example, then the transfer belt 16 is heated by this heating device, and the unreacted treatment liquid and surplus solvent are caused to evaporate. However, this does not remove all of the solvent and therefore, in order to further remove the solvent, a solvent removal member and a solvent recovery mechanism are provided on the downstream side of the print unit 12 in terms of the conveyance direction of the transfer belt 16.

As shown in FIG. 1, the solvent removal member includes a solvent absorbing roller 42 which makes contact with a solvent 40 on the transfer belt 16 so as to absorb the solvent 40. The solvent absorbing roller 42 has a porous structure in such a manner that it absorbs the solvent when abutting against the transfer belt 16 on which ink has been printed. The majority of the solvent remaining on the transfer belt 16 is removed by means of this solvent absorbing roller 42 having the porous structure.

Furthermore, the solvent recovery mechanism 44 includes an opening section 46 through which a solvent is sucked up from the solvent absorbing roller 42, a pump 48 connected to the opening section 46, and a receptacle 50 which stores the recovered solvent. In the solvent recovery mechanism 44, by abutting the opening section 46 against the solvent absorbing roller 42, driving the pump 48, and suctioning air from the opening section 46, the pressure inside the opening section 46 is reduced. Thereby, a pressure differential is created between the opening section 46 and the solvent absorbing roller 42, and the solvent absorbed into the solvent absorbing roller 42 is absorbed from the opening section 46 and this solvent is recovered in the receptacle 50. The solvent recovery mechanism 44 is described in more detail below.

When the recording paper 20 conveyed by the conveyance belt 22 passes between the first transfer roller 24 and the second transfer roller 26, then due to the transfer belt 16 making contact with the recording paper 20, the image formed on the transfer belt 16, from which the surplus solvent has been removed by the solvent absorbing roller 42, is transferred from the transfer belt 16 to the recording paper 20. In this case, the first transfer roller 24 and the second transfer roller 26 are controlled in such a manner that the contact pressure of the recording paper 20 against the surface of the transfer belt 16 assumes a prescribed pressure.

Furthermore, as shown in FIG. 1, the inkjet recording apparatus 10 also comprises the cleaning blade 34 for cleaning the surface of the transfer belt 16 after the image formed on the surface of the transfer belt 16 has been transferred to the recording paper 20.

The cleaning blade 34 is provided in the front stage of the print unit 12 (i.e., before the print unit 12), and it cleans the surface of the transfer belt 16 before the corresponding portion of the transfer belt 16 enters into the printing of the next image. The cleaning blade 34 is a thick plate-shaped member which is constituted by an elastic member, such as a non-woven cloth or rubber. The cleaning blade 34 is disposed rotatably about an axle 34*a*, and when the cleaning of the surface of the transfer belt 16 is carried out, the front end section of the cleaning blade 34 rubs against the surface of the transfer belt 16.

Figure 2A:
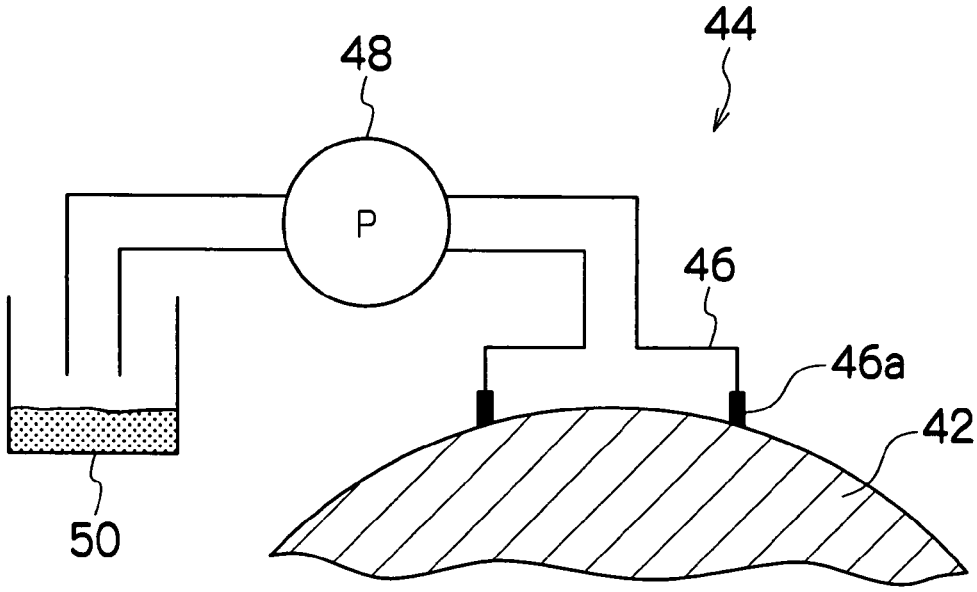
FIG. 2A is a front view showing an enlarged view of the solvent recovery mechanism shown in FIG. 1.
Figure 2B:
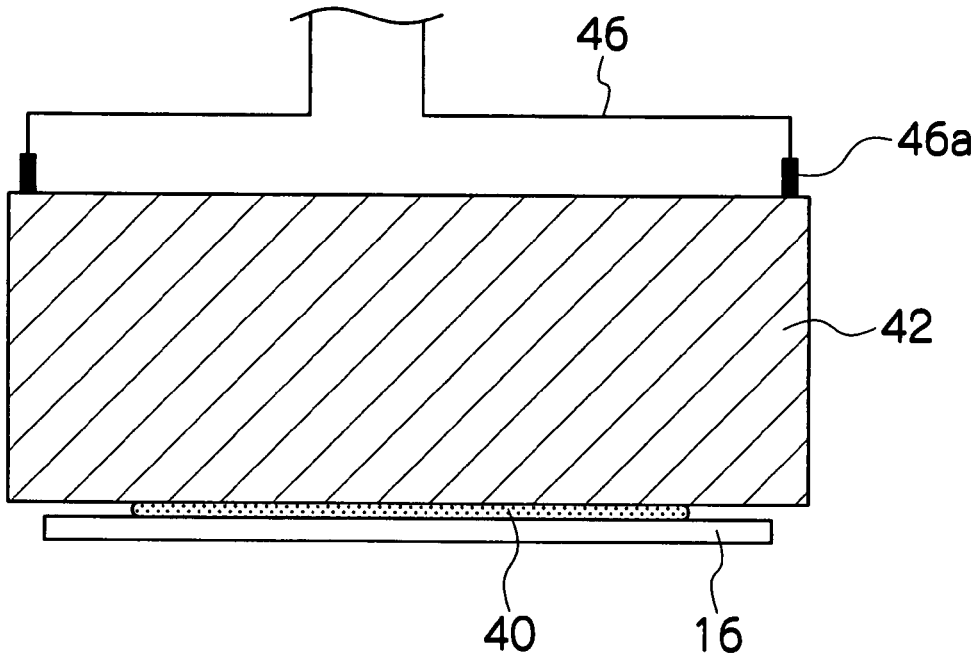
FIG. 2B is a cross-sectional side view illustrating the relationship between the opening section of a solvent recovery mechanism and a solvent absorbing roller, as observed in the direction of the transfer belt.

FIGS. 2A and 2B show expanded views of the solvent recovery mechanism 44. FIG. 2A is an expanded front view of the solvent recovery mechanism 44 shown in FIG. 1, and FIG. 2B is a cross-sectional side diagram illustrating, in particular, the relationship between the opening section 46 of the solvent recovery mechanism 44 and the solvent absorbing roller 42, as viewed in the conveyance direction of the transfer belt 16.

As shown in FIGS. 2A and 2B, the opening section 46 of the solvent recovery mechanism 44 has a rectangular parallelepiped shape containing a rectangular shaped opening having a length corresponding to the full width of the transfer belt 16 in terms of the lengthwise direction of the solvent absorbing roller 42. Furthermore, the portion of the opening section 46 which makes contact with the surface of the solvent absorbing roller 42 is constituted by a soft elastic body 46*a* made of rubber. Since the portion of the opening section 46 which makes contact with the solvent absorbing roller 42 is constituted by a soft member in this way, it is possible to reduce the damage to the solvent absorbing roller 42 when the opening section 46 is placed in tight contact with the solvent absorbing roller 42 so as to recover the solvent from the solvent absorbing roller 42.

In this way, in the solvent recovery mechanism 44 according to the present embodiment, when recovering solvent from the solvent absorbing roller 42, the opening section 46 is placed in tight contact with the surface of the solvent absorbing roller 42 and the solvent is sucked up by creating a pressure differential by means of the pump 48, consequently avoiding problems associated with the related art where, for example, a solvent absorbing roller is made of a soft member, such as a sponge, and the sponge roller readily becomes damaged and ceases to be usable when the solvent absorbed into the sponge roller is squeezed out by pressing a blade against the sponge roller.

Below, the action of the present embodiment is described.

Firstly, the treatment liquid is ejected from the treatment liquid ejection head 12S onto the region of the transfer belt 16 where Y ink is to be ejected, on the basis of the image data. Thereupon, with the conveyance of the transfer belt 16, Y ink is ejected from the print head 12Y onto the region where the treatment liquid has just been ejected. Thereafter, in a similar fashion, the treatment liquid is ejected from treatment liquid ejection heads 12S onto the region where the inks of the respective colors are to be ejected on the basis of the image data, and the inks of the respective colors are ejected from the print heads 12M, 12C and 12K. In this way, an image is formed.

When the inks of the respective colors are ejected onto the transfer belt 16, the inks and the treatment liquid which is ejected previously produce an aggregation reaction, whereby the coloring material becomes insoluble and thus landing interference and bleeding of the ink are prevented.

If the guide plate 18 below the transfer belt 16 is provided with a heating device, then it is desirable that the transfer belt 16 should also be heated during conveyance of the transfer belt 16 in such a manner that the ink solvent is caused to evaporate and is removed as far as possible.

When the solvent 40 on top of the transfer belt 16 comes into contact with the solvent absorbing roller 42 (see FIG. 1), then the solvent still remaining on the transfer belt 16 is absorbed by the solvent absorbing roller 42 which has a porous structure.

The image on the transfer belt 16 from which the solvent 40 has been absorbed is pressed against the recording paper 20 by the first transfer roller 24 and the second transfer roller 26, and thereby transferred to the recording paper 20. In this way, an image is formed on the recording paper 20. The recording paper 20 on which an image has been formed is output to a paper output unit which is not shown in FIG. 1.

On the other hand, when recovering the solvent that has been absorbed by the solvent absorbing roller 42, the opening section 46 of the solvent recovery mechanism 44 is placed in tight contact with the solvent absorbing roller 42, and a negative pressure is created in the opening section 46 by driving the pump 48, thereby causing the liquid to be sucked in from the opening section 46. The solvent sucked up in this way is recovered in the receptacle 50.

In this way, in the present embodiment, the solvent that has been absorbed by the solvent absorbing roller having a porous structure is sucked up by the pump and recovered, and therefore it is possible to recover the solvent efficiently without causing damage to the solvent absorbing body (the solvent absorbing roller).

Next, a second embodiment of the present invention is described below.

Figure 3A:
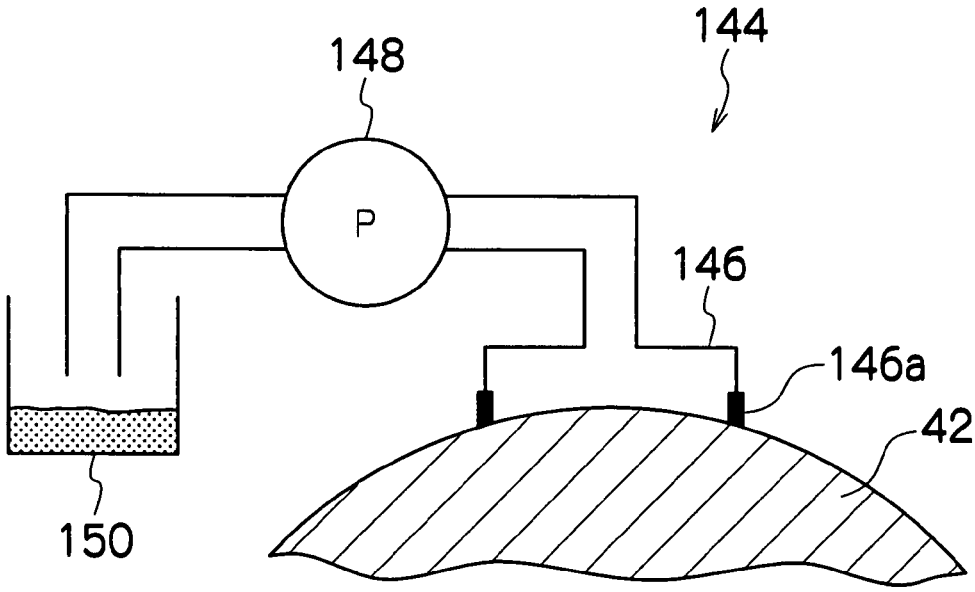
FIG. 3A is an enlarged front view of a solvent recovery mechanism according to a second embodiment.
Figure 3B:
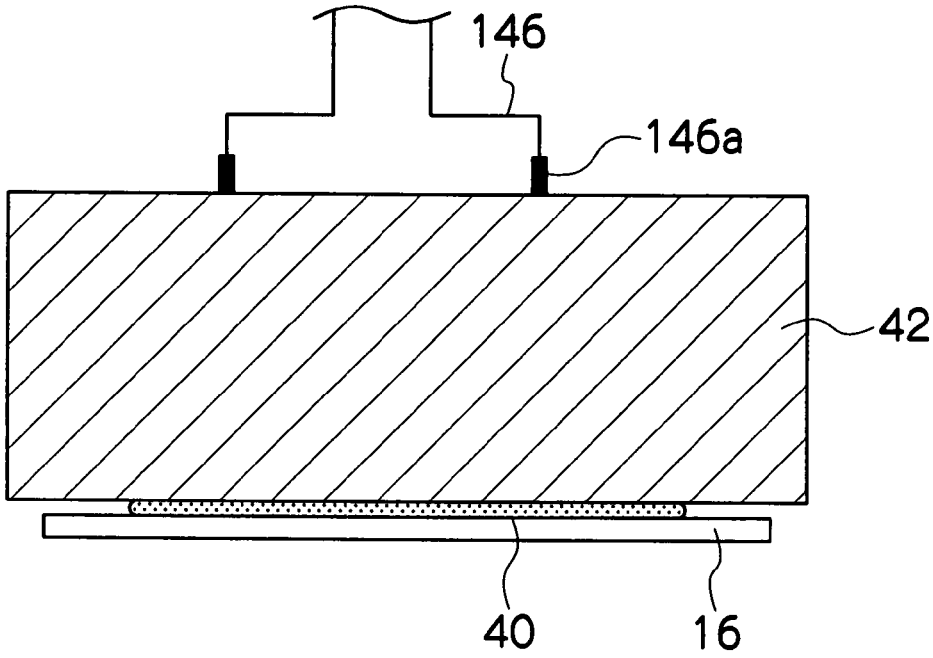
FIG. 3B is a cross-sectional side view of it as observed in the conveyance direction of the transfer belt.

FIGS. 3A and 3B show a solvent recovery mechanism relating to the second embodiment.

Similarly to FIGS. 2A and 2B, FIG. 3A is an enlarged front view of a solvent recovery mechanism and FIG. 3B is a cross-sectional side view of same, observed in the conveyance direction of the transfer belt.

As shown in FIGS. 3A and 3B, similarly to the first embodiment, the solvent recovery mechanism 144 according to the second embodiment includes an opening section 146, a pump 148 and a receptacle 150, and the portion of the opening section 146 which makes contact with the surface of the solvent absorbing roller 42 is formed by a soft elastic body 146*a* made of rubber.

As shown in FIG. 3A, when viewed from the front side, the solvent recovery mechanism 144 according to the present embodiment is similar to the solvent recovery mechanism 44 according to the first embodiment, but as shown in FIG. 3B, the width of the opening section 146 as viewed in the conveyance direction of the transfer belt 16 is formed to be smaller than the width of the transfer belt 16.

Although the width of the opening section 146 of the solvent recovery mechanism 144 is shorter than the width of the transfer belt 16 in this way, the solvent absorbing roller 42 comprises a porous structure. Hence, even if the roller is suctioned by the pump 148 in a portion of the roller only, the suctional force is transmitted throughout the whole of the solvent absorbing roller 42 because of the porous structure, and no problems arise. If the width of the opening section 146 is reduced, then this has the beneficial effect of raising the suctional force because of narrowing the suction aperture.

In the embodiment shown in FIG. 3B, the opening section 146 is disposed in substantially the central portion of the solvent absorbing roller 42 in terms of the lengthwise direction. As described previously, since the suctioning force is transmitted throughout the whole of the roller even if it is suctioned from a portion of the roller only, then the opening section 146 may be disposed in any position with respect to the roller.

Furthermore, the remainder of the composition of the present embodiment is similar to that of the first embodiment described above, and therefore, detailed description thereof is omitted here.

Next, a third embodiment of the present invention is described below.

Figure 4:
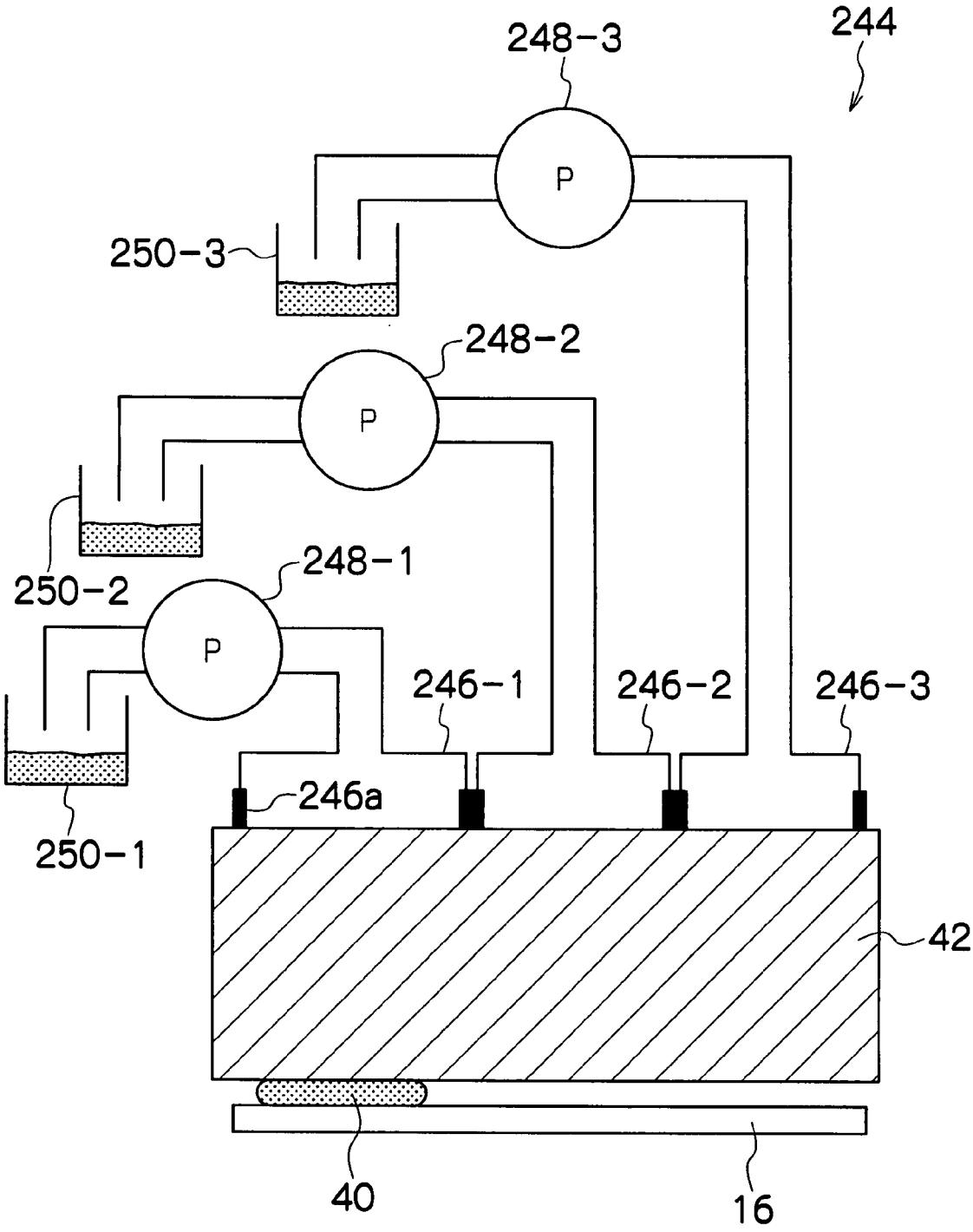
FIG. 4 is a side view of the solvent recovery mechanism according to a third embodiment, as observed in the conveyance direction of the transfer belt.

FIG. 4 shows a solvent recovery mechanism according to the third embodiment. As shown in FIG. 4, the solvent recovery mechanism 244 according to the present embodiment is disposed in such a manner that three opening sections 246-1, 246-2 and 246-3 having short suction openings are disposed in such a manner that they cover the solvent absorbing roller 42 (the axial direction of the roller), from end to end, in terms of the lengthwise direction, in three separate sections.

These opening sections 246-1, 246-2, and 246-3 are connected respectively to pumps 248-1, 248-2 and 248-3, and to receptacles 250-1, 250-2, and 250-3. The pumps 248-1, 248-2, and 248-3 can be driven respectively and independently, in such a manner that the solvent can be absorbed respectively and independently from the opening sections 246-1, 246-2, and 246-3.

Consequently, in the present embodiment, by providing a plurality of opening sections 246-1, 246-2 and 246-3 having short suction apertures, in the lengthwise direction of the solvent absorbing roller 42, it is possible to operate, individually, a particular pump (any one of 248-1, 248-2 and 248-3) that is connected to a particular opening section (any one of 246-1, 246-2 and 246-3) which is in a position corresponding to the portion where the solvent is present on the transfer belt 16.

For instance, in the example shown in FIG. 4, since the solvent 40 is located on the left-hand side of the diagram, then it is possible to absorb this solvent efficiently by operating only the pump 248-1 relating to the opening section 246-1 which corresponds to this position.

In the embodiment shown in FIG. 4, the opening section is divided into three sections 246-1, 246-2 and 246-3, but the number of divisions is not limited to three and the opening section may be divided into any number of sections. Furthermore, receptacles 250-1, 250-2 and 250-3 are provided respectively for the opening sections 246-1, 246-2 and 246-3, but it is also possible to use one receptacle for all of the opening sections, in such a manner that the recovered solvent is all collected together.

Next, a fourth embodiment of the present invention is described below.

Figure 5A:
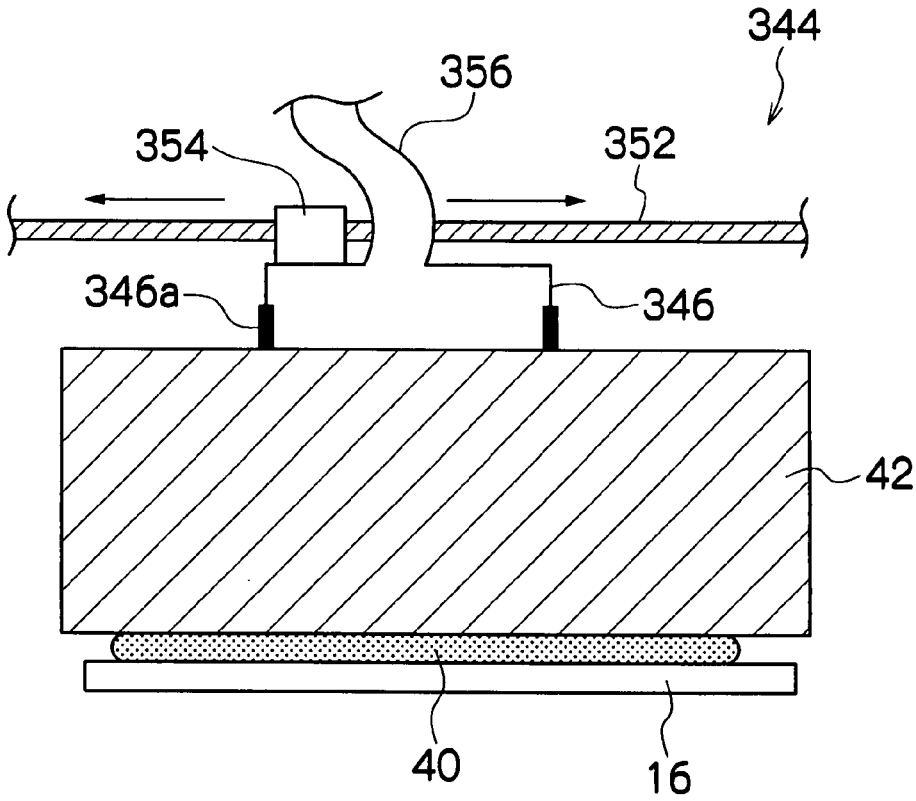
FIGS. 5A and 5B are side views of the solvent recovery mechanism according to a fourth embodiment, as observed in the conveyance direction of the transfer belt.
Figure 5B:
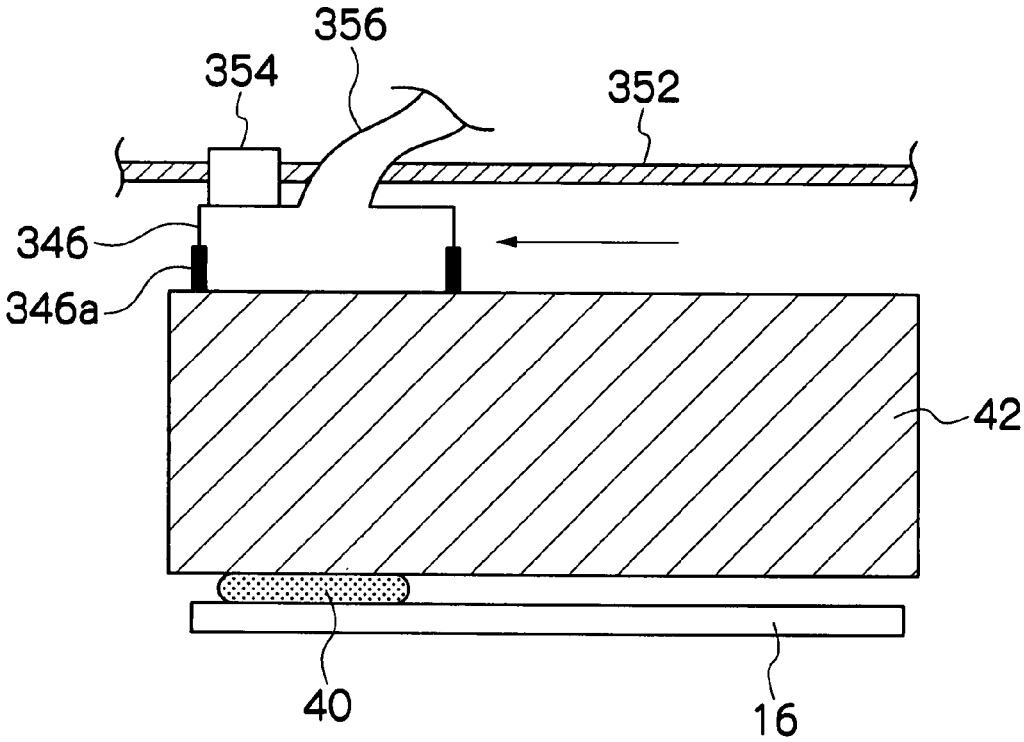

FIGS. 5A and 5B show a solvent recovery mechanism according to the present embodiment. As shown in FIGS. 5A and 5B, in the solvent recovery mechanism 344 according to the present embodiment, an opening section 346 having a short suction aperture is disposed movably in the lengthwise direction of the solvent absorbing roller 42 (the axial direction of roller).

There are no particular restrictions on the movement device used to move the opening section 346 in the axial direction of the solvent absorbing roller 42, and for example, it is possible to use a ball screw, and the like, as shown in FIGS. 5A and 5B.

In other words, the opening section 346 is fixed by a nut 354 to the screw shaft 352, in such a manner that it can be moved along the screw shaft 352 by means of the rotation of the screw shaft 352. Moreover, it is desirable that the pipe 356 which connects the opening section 346 with the pump (not shown in FIGS. 5A and 5B) should be made of a flexible member, in such a manner that it is able to deform freely.

In the present embodiment, since the opening section 346 is able to move in the axial direction of the solvent absorbing roller 42, then it is possible to position the opening section 346 at any point in the axial direction of the solvent absorbing roller 42.

For example, if the solvent 40 is present on substantially the whole surface of the transfer belt 16 in the breadthways direction, as shown in FIG. 5A, then the opening section 346 should be disposed in substantially the central portion of the solvent absorbing roller 42, as in the second embodiment shown in FIG. 3B, which is described previously.

Furthermore, if the solvent 40 is present only on a portion of the transfer belt 16, as shown in FIG. 5B, then by moving the opening section 346 to the corresponding position, it is possible to recover this solvent 40 efficiently.

Next, a fifth embodiment of the present invention is described below.

Figure 6A:
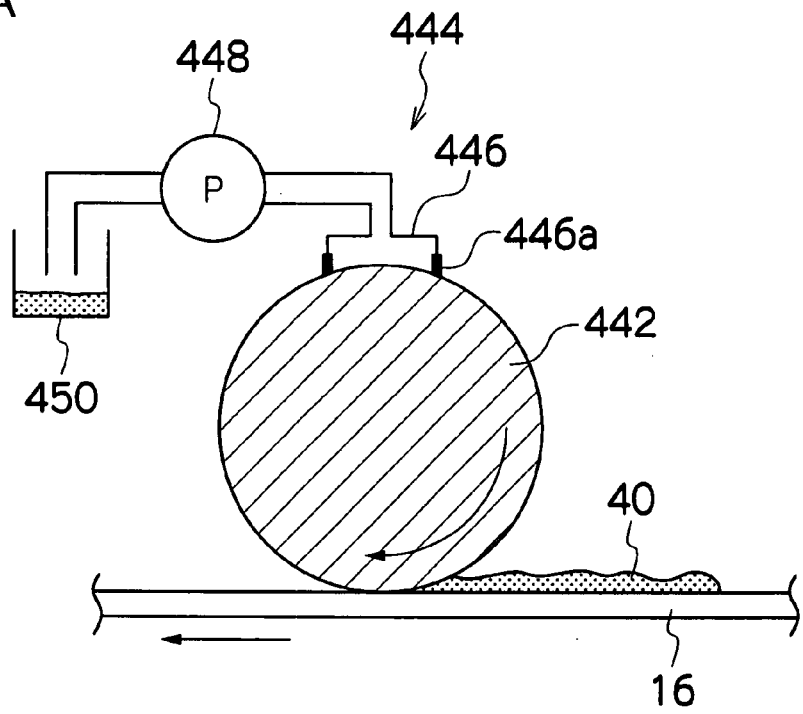
FIG. 6A is a front view showing the solvent recovery mechanism according to a fifth embodiment.
Figure 6B:
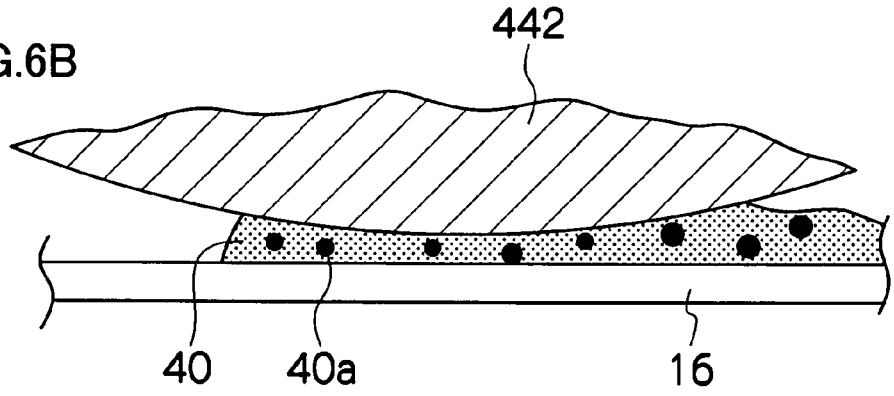
FIGS. 6B and 6C are enlarged views showing states of suctioning of solvent.
Figure 6C:
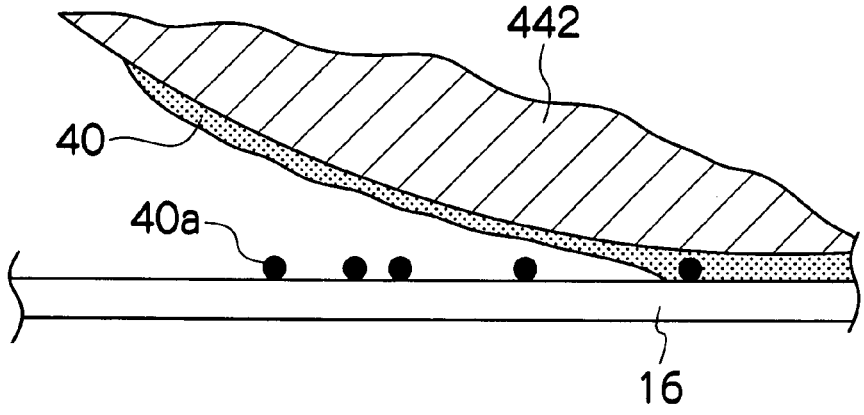

FIGS. 6A to 6C show a solvent recovery mechanism according to the present embodiment. As shown in FIG. 6A, similarly to the solvent recovery mechanism 44 according to the first embodiment described above, the solvent recovery mechanism 444 according to the present embodiment comprises an opening section 446 which makes contact with the surface of a solvent absorbing roller 442 which absorbs the solvent 40 on the transfer belt 16, a pump 448 which is connected to the opening section 446, and a receptacle 450 which collects the recovered solvent. Furthermore, the portion of the opening unit 446 which makes contact with the solvent absorbing roller 442 is formed by an elastic member 446*a* made of rubber.

The present embodiment differs from the first embodiment in that the surface energy $\gamma 1$ of the surface of the solvent absorbing roller 442 is greater than the surface energy $\gamma 3$ of the surface of the transfer belt 16.

By making the surface energy γ1 of the surface of the solvent absorbing roller 442 greater than the surface energy γ3 of the surface of the transfer belt 16 in this way, the absorptivity of the solvent by the solvent absorbing roller 442 is increased, and the adherence of the coloring material to the solvent absorbing roller 442 is reduced.

The coloring material tends to have a greater affinity with objects having a lower surface energy. For example, if the transfer belt 16 is made of PET having a surface energy of γ3=49 (mN/m) and the surface of the solvent absorbing roller 442 is made of $TiO_2$ having a surface energy γ1=65 (mN/m), then substantially 100% of the coloring material remains on the transfer belt 16, and only the solvent is absorbed by the solvent absorbing roller 442.

The reason why the coloring material has poor affinity with objects having a high surface energy is, firstly, that the higher the surface energy, the greater the hydrophilic properties, and since the coloring material which has aggregated in the solvent after the two-liquid reaction is considered to be hydrophobic, then it has low affinity with a hydrophilic surface. Furthermore, a second reason is thought to be the fact that, the higher the surface energy of a surface, the more readily the water component spreads over and wets the surface. The water thin film thus created restricts the adherence of the coloring material.

In other words, as shown in FIG. 6B, when the solvent absorbing roller 442 makes contact with the transfer belt 16, the coloring material 40*a* which has aggregated due to the two-liquid reaction is present in the solvent 40.

Furthermore, as shown in FIG. 6C, as the solvent absorbing roller 442 rotates as the transfer belt 16 is conveyed further, the surface of the solvent absorbing roller 442 is separated from the transfer belt 16. In this case, the surface energy γ1 of the surface of the solvent absorbing roller 442 is greater than the surface energy γ3 of the transfer belt 16. Therefore, as stated previously, whereas the surface of the solvent absorbing roller 442 is relatively hydrophilic, the coloring material 40*a* is relatively hydrophobic. Furthermore, a thin film of the solvent 40 is formed on the surface of the solvent absorbing roller 442, which suppresses adherence of the coloring material 40*a* to the surface of the solvent absorbing roller 442. Consequently, the coloring material 40*a* is left on the transfer belt 16 and only the solvent 40 is absorbed by the solvent absorbing roller 442.

In this case, the coloring material 40*a* may be pulled toward the surface of the solvent absorbing roller 442 and become separated from the transfer belt 16, although this occurs in small quantities. This coloring material 40*a* may remain on the surface of the solvent absorbing roller 442 and become absorbed into the porous material of the interior of the solvent absorbing roller 442, together with the solvent 40. In this case, since all of the holes are connected together, even supposing that this phenomenon is repeated and that some of the holes become blocked, there will only be a slight reduction in the capillary action and no deterioration in the absorption capacity of the solvent absorbing roller 442 will occur. However, if the coloring material 40*a* is also recovered together with the solvent 40, by the solvent recovery mechanism 444, then this may cause a decline in the recovery capability, and there is a possibility that it will become difficult to recover the prescribed amount of solvent 40 from the solvent absorbing roller 442.

Therefore, in order to reduce the adherence of coloring material 40*a* to the surface of the solvent absorbing roller 442, the surface energy γ1 of the surface of the solvent absorbing roller 442 and the surface energy γ2 of the inner surface of the solvent absorbing roller 442 may be subjected to restrictions, as in a sixth embodiment which is described below.

Next, a sixth embodiment of the present invention is described below.

The composition of the solvent absorbing roller and the solvent recovery mechanism according to the sixth embodiment is similar to those of the fifth embodiment described above.

In the present embodiment, the surface energy γ2 of the inner surface of the solvent absorbing roller (namely, the surface on the sides of the holes which create the capillaries in the porous structure) is specified. In other words, looking solely at the recovery of solvent from the solvent absorbing roller by means of the solvent recovery mechanism, it is desirable that the surface energy γ2 of the interior of the surface absorbing roller should be low.

Figure 7A:
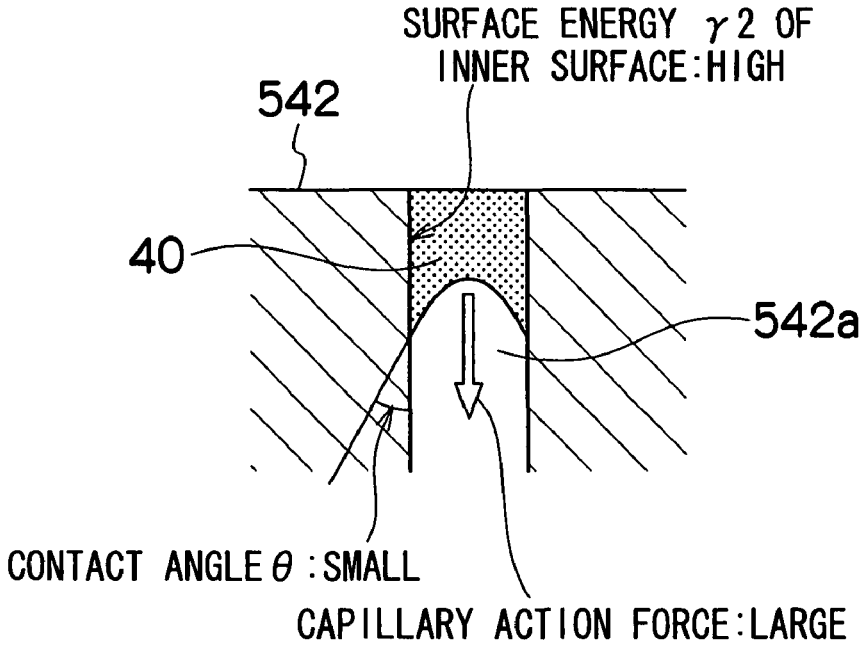
FIGS. 7A and 7B are enlarged views of a capillary of a solvent absorbing roller.
Figure 7B:
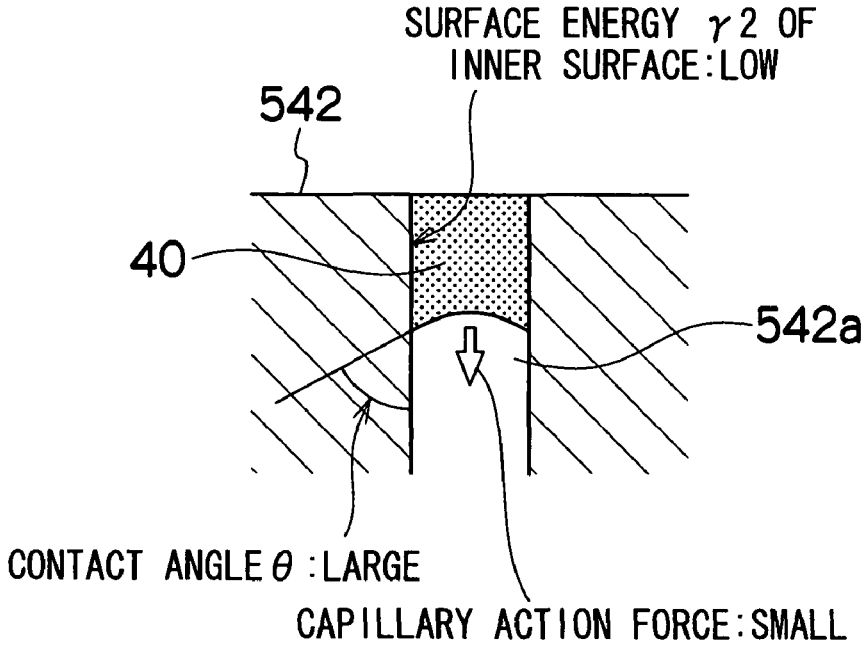

This is because, as shown in FIG. 7A, if the surface energy γ2 of the interior of the solvent absorbing roller 542 is high, then the angle θ of contact between the side of one hole (capillary) 542*a* and the solvent 40 which has been absorbed into the hole 542*a* of the porous structure of the solvent absorbing roller 542 is small, and the capillary action is high. Furthermore, as shown in FIG. 7B, if the surface energy γ2 of the interior of the solvent absorbing roller 542 is small, then the angle θ of contact between the solvent 40 and the side face of the hole 542*a* of the solvent absorbing roller 542 is large, and the capillary action is low. In other words, if the solvent 40 absorbed into the hole 542*a* is suctioned from the exterior by a pump, then it must be suctioned with a suctioning force that is greater than the capillary action, and therefore, if the capillary action is lower, then the suctioning force can be reduced correspondingly.

Consequently, in order to reduce the adherence of coloring material to the solvent absorbing roller 542 and also facilitate recovery of the solvent 40, it is desirable that the surface energy γ2 of the interior of the solvent absorbing roller 542 should be low. Therefore, in the present embodiment, the interior of the solvent absorbing roller 542 is set to have a low surface energy γ2.

Moreover, desirably, the surface energy γ2 of the interior of the solvent absorbing roller 542 is made to be smaller than the surface energy γ1 of the surface of the solvent absorbing roller 542.

Figure 8A:
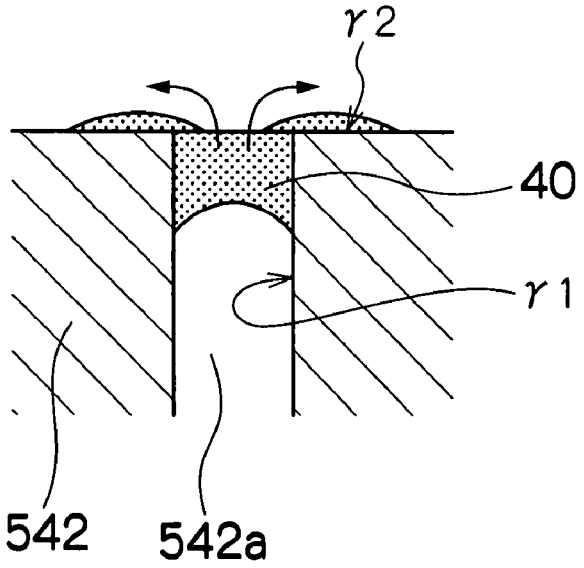
FIG. 8A is an enlarged view of a capillary of a solvent absorbing roller according to a sixth embodiment.
Figure 8B:
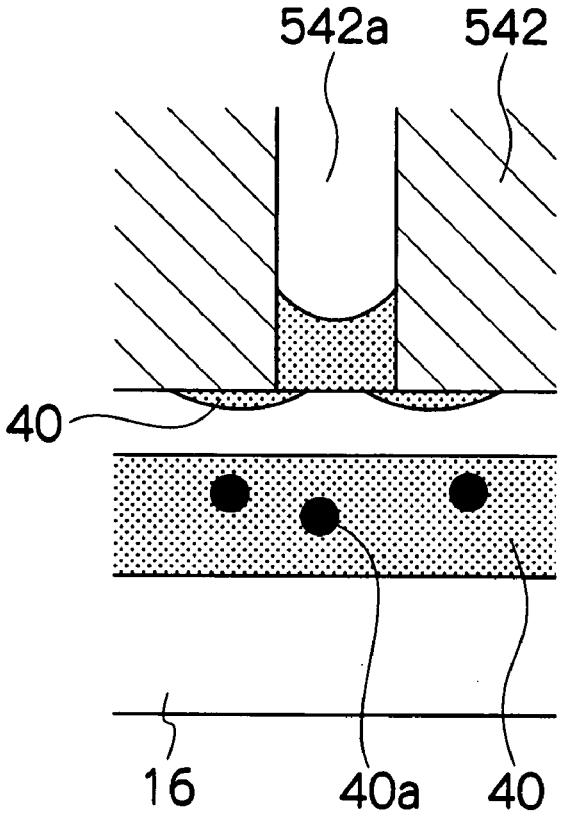
FIG. 8B is an enlarged view showing a state of absorbing the solvent from a transfer belt.

This is because, as shown in FIG. 8A, if the solvent 40 absorbed into the hole 542*a* of the solvent absorbing roller 542 is located in the vicinity of the surface, then spreading and wetting of the solvent 40 occurs, from the interior of the hole (capillary) 542*a* having low surface energy γ2, onto the surface having high surface energy γ1. Consequently, as shown in FIG. 8B, if the solvent on the transfer belt 16 is absorbed subsequently in a state where this wet solvent 40 is remaining in a thin layer on the surface of the roller, then the coloring material 40*a* is prevented from making contact with the surface of the solvent absorbing roller 542, and hence the adherence of the coloring material 40*a* onto the solvent absorbing roller 542 is suppressed.

Figure 9A:
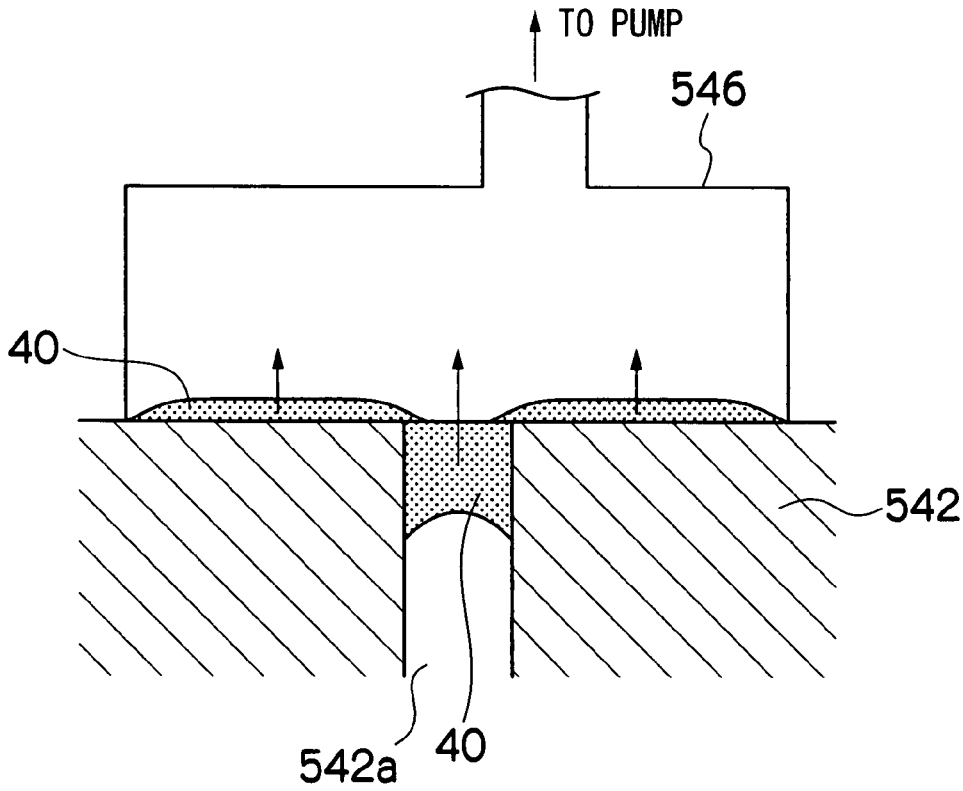
FIGS. 9A and 9B are enlarged views of states of recovering the solvent according to the sixth embodiment.

Furthermore, even in cases where the solvent 40 absorbed into the solvent absorbing roller 542 is recovered by means of the pump of the solvent recovery mechanism, as shown in 25 FIG. 9A, if the surface energy γ2 of the interior of the solvent absorbing roller 542 is made smaller than the surface energy γ1 of the surface of the solvent absorbing roller 542, then the solvent 40 will readily spread out onto the surface, and hence the excess solvent 40 can be recovered in a highly efficient manner.

Figure 9B:
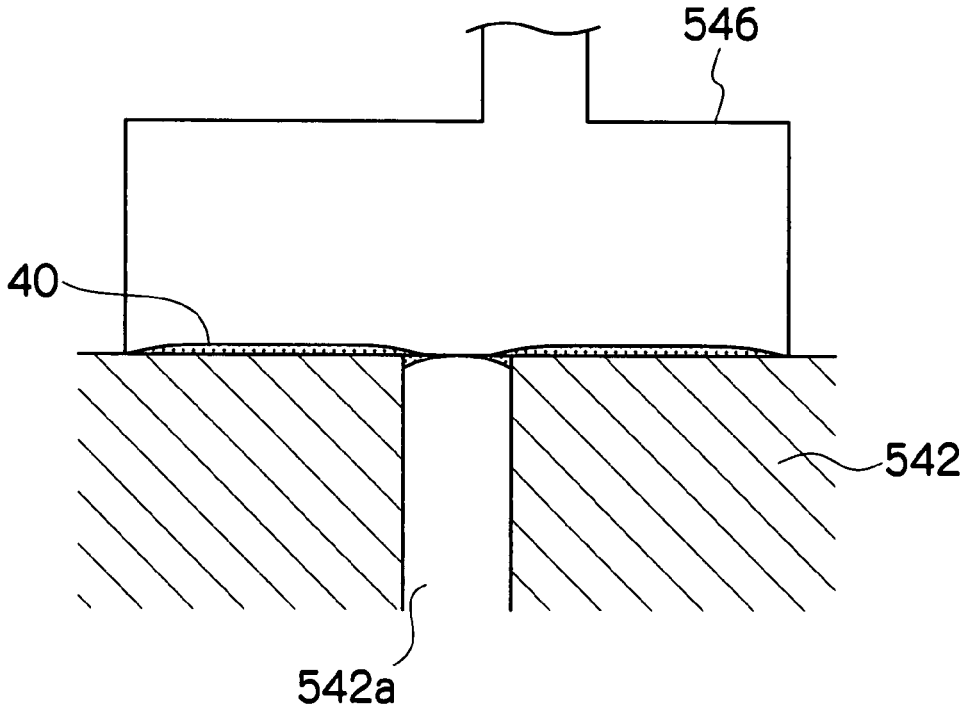

As shown in FIG. 9B, even in cases such as these, it is difficult to remove all of the solvent 40 on the surface, completely, and therefore the beneficial effects in suppressing adherence of coloring material, which are achieved by the presence of solvent on the surface or the roller due to the wetting and spreading of the solvent 40 described above, can be maintained. On the contrary, it is possible to leave only the minimum required amount of solvent, and to recover the surplus solvent more reliably. In FIGS. 9A and 9B, in order to facilitate the description, the opening section 546 is depicted on a much reduced scale compared to the hole (capillary) 542*a* of the solvent absorbing roller 542.

Next, a seventh embodiment of the present invention is described below.

As stated above, if the solvent is recovered by placing an opening section having a suction aperture in contact with the surface of a solvent absorbing roller and then suctioning by means of a pump, there may be cases where, depending on the print operation, printing is carried out only on a portion of the transfer belt and hence only a portion of the solvent absorbing roller is filled with the solvent. In this case, since the solvent absorbing roller has a porous structure, then when the solvent is recovered by suctioning with a pump, at first, the pump principally suctions air, and an amount of exhaust air of the pump rises massively.

Therefore, in the present embodiment, a liquid is deposited on the solvent absorbing roller at an intermediate point, and the deposited liquid combines with the print solvent to create a state where the surface of the porous structure is filled with the solvent, in such a manner that even if the print region is smaller than the solvent recovery aperture, the suction aperture connected with the pump can be filled with this liquid. Thus, it is possible to prevent the air from being suctioned unnecessarily and allow the solvent to be removed with good efficiency.

Figure 10A:
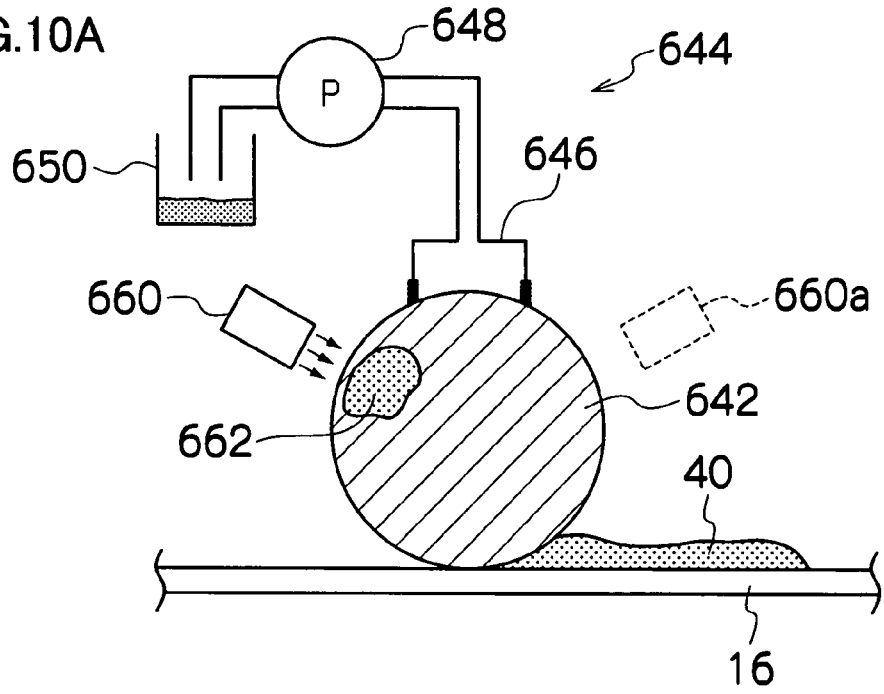
FIG. 10A is a front view showing the solvent recovery mechanism according to a seventh embodiment.

FIG. 10A shows a solvent recovery mechanism according to the present embodiment.

As shown in FIG. 10A, the solvent recovery mechanism 644 according to the present embodiment comprises: an opening section 646 which makes contact with the surface of a solvent absorbing roller 642 which absorbs the solvent 40 on the transfer belt 16; a pump 648; a receptacle 650; and a liquid deposition device 660 which gives a liquid 662 to the solvent absorbing roller 642.

The liquid deposition device 660 gives the liquid 662 to the solvent absorbing roller 642 in such a manner that the portion of the solvent absorbing roller 642 which makes contact with the opening section 646 is filled with the solvent 40 and the liquid 662. The liquid deposition device 660 has a width corresponding to the full width of the solvent absorbing roller 642 in the lengthwise direction (the axial direction of the roller), and it is formed so that the liquid is given to the solvent absorbing roller 642 over the full width of the solvent absorbing roller 642. Furthermore, there are no particular restrictions on the method of depositing liquid, and the liquid may be deposited to the solvent absorbing roller 642 by nozzles ejecting the liquid, or by smearing the liquid onto the solvent absorbing roller 642. Furthermore, this liquid may also be a cleaning liquid which dissolves the components other than water in the solvent (such as coloring material and polymers), thereby providing a beneficial effect in preventing blockages in the porous structure during recovery of the solvent.

There are no restrictions on the arrangement position of the liquid deposition device 660, which is indicated by a solid line in FIG. 10A, and it may also be disposed in the position indicated by the broken line 660*a* in FIG. 10A.

Figure 10B:
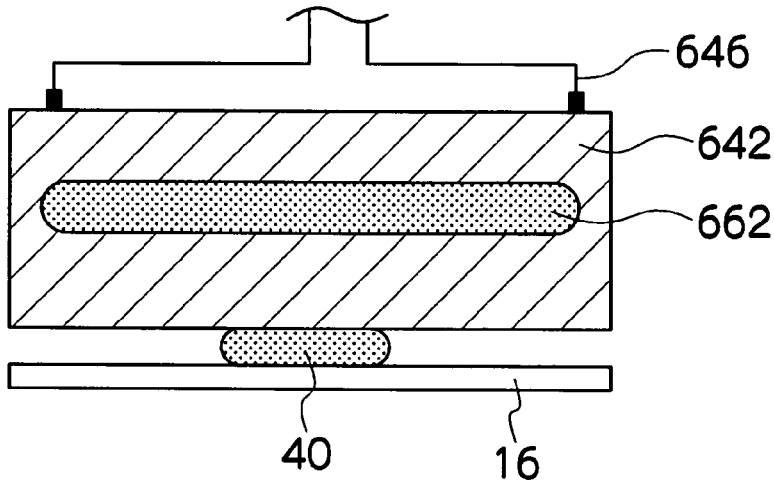
FIGS. 10B and 10C are side views showing states of suctioning the solvent from a solvent absorbing roller.
Figure 10C:
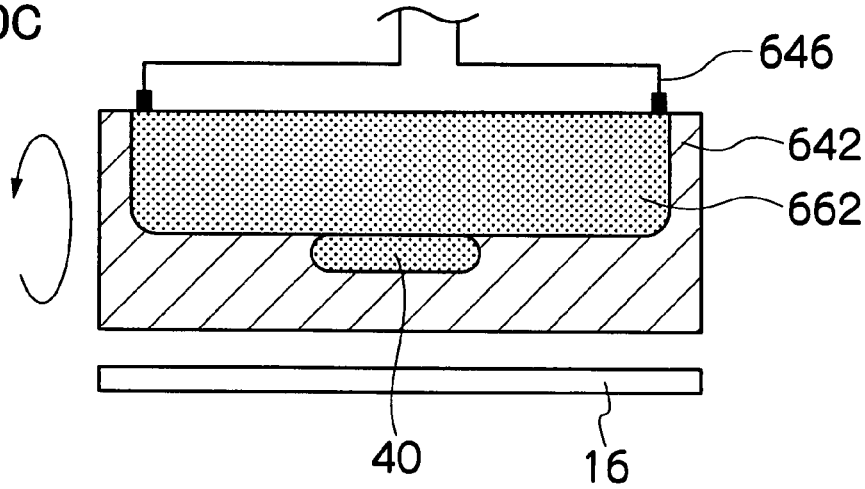

Furthermore, as shown in FIG. 10B, even if the solvent 40 is present only on a portion of the transfer belt 16 on the basis of the printing data, the liquid 662 is still given to the full width of the solvent absorbing roller 642 by the liquid deposition device 660. Consequently, as shown in FIG. 10C, as the liquid deposition device 660 continues to give the liquid 662 to the solvent absorbing roller 642 while the solvent absorbing roller 642 is rotated, the liquid 662 and the solvent 40 come into contact, and the solvent 40 spreads uniformly in the lengthwise direction of the solvent absorbing roller 642 (the axial direction of the roller).

Accordingly, even in cases where the solvent is only present in a portion of the part of the solvent absorbing roller 642 corresponding to the position of the opening section 646, it is still possible to recover the solvent efficiently while the suctioning air is prevented.

Next, an eighth embodiment of the present invention is described below.

In this embodiment, it is sought to recover the solvent more efficiently, by adjusting the suctioning force of the pump in such a manner that a certain uniform amount of the solvent is left after the solvent recovery.

Figure 11:
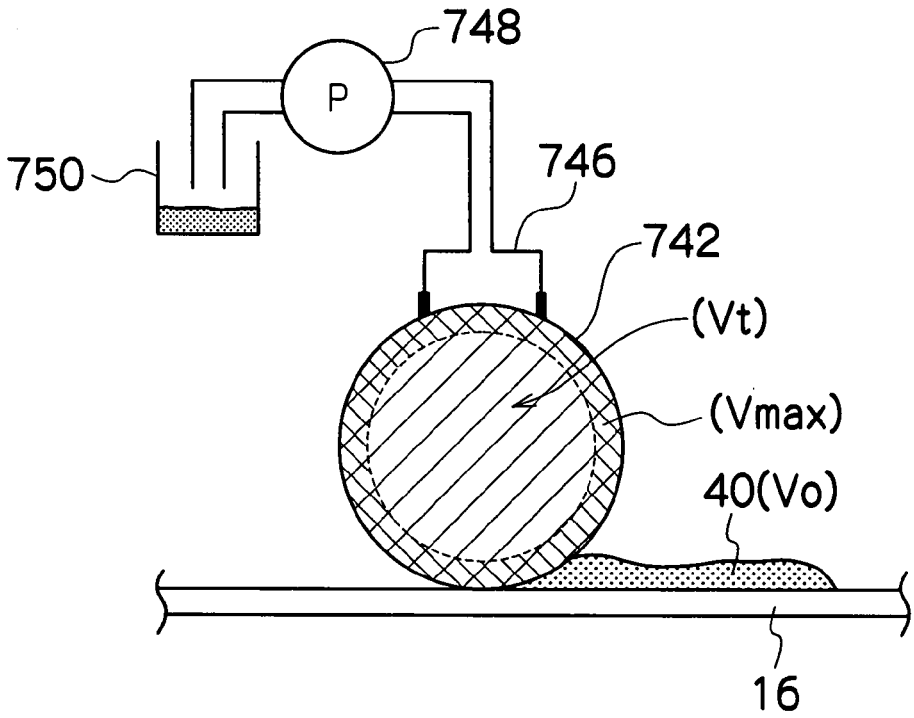
FIG. 11 is a front view showing a solvent recovery mechanism according to an eighth embodiment.

FIG. 11 shows a solvent recovery mechanism according to the present embodiment. As shown in FIG. 11, the composition of the solvent recovery mechanism is similar to that of the first embodiment, which is described previously. In other words, the solvent 40 on the transfer belt 16 is absorbed by a solvent absorbing roller 742, an opening section 746 is placed in contact with the surface of the solvent absorbing roller 742, and the solvent 40 is recovered by operating a pump 748, in such a manner that the solvent is recovered into a receptacle 750.

In the present embodiment, by ensuring that a uniform amount of the solvent is always left inside the porous structure of the solvent absorbing roller 742, it is possible to recover the solvent efficiently when the solvent is recovered by means of the pump 748.

As shown in FIG. 11, taking $V_o$ to be the volume of solvent on the transfer belt 16, taking $V_t$ to be the maximum liquid absorption capacity of the solvent absorbing roller 742, taking $V_{max}$ to be the maximum solvent absorption volume that can be absorbed by the solvent absorbing roller 742, and taking $V_{zan}$ to be the remaining amount of solvent left after the recovery, then the (porous structure of) the solvent absorbing roller 742 must have an absorption capacity which allows it to remove the solvent of at least the maximum solvent absorption volume $V_{max}$ that is required in the next solvent absorption process, in addition to the remaining amount of solvent, $V_{zan}$.

Therefore, it is possible to leave a volume of the solvent up to the amount given by subtracting the maximum solvent absorption volume $V_{max}$ from the maximum liquid absorption capacity $V_t$ of the porous structure of the solvent absorbing roller 742 when the solvent absorbing roller 742 is dry. From this, the remaining amount of solvent, $V_{zan}$, satisfies the following relationship: $V_{zan} \leqq V_t - V_{max}$. Here, the maximum solvent absorption volume $V_{max}$ is equal to or greater than 75% of the estimated solvent volume when printing is performed at the maximum rate.

Furthermore, if only a part of the printing region is used at the start of printing, then it takes some amount of time for the roller to become filled with solvent. However, the roller has a porous structure, and therefore the solvent gradually spreads in all four directions. Hence, after a certain number of prints have been made, the solvent absorbing roller becomes filled with the solvent in terms of the lengthwise direction. Therefore, the throughput (amount of exhaust air) of the pump is high until this state is reached; however, once the roller has become full, it is possible to achieve the required recovery volume with a low pump throughput.

Next, a ninth embodiment of the present invention is described below.

In the present embodiment, the solvent is recovered from a solvent absorbing roller during the off line state, by withdrawing the solvent absorbing roller to a separate location.

Figure 12:
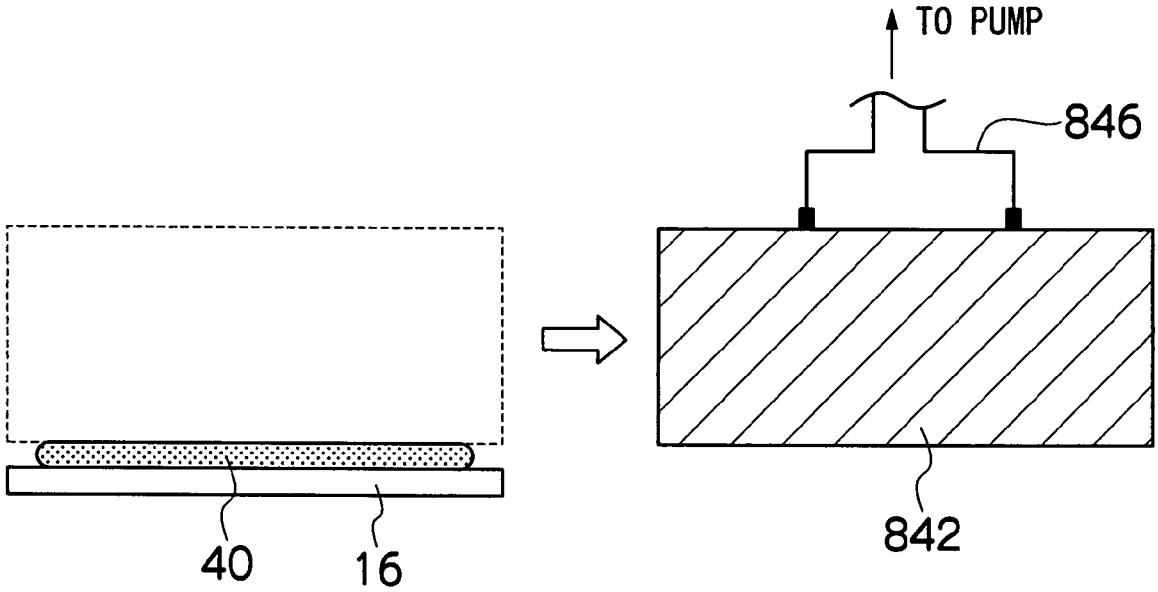
FIG. 12 is a side view showing a solvent recovery mechanism according to a ninth embodiment.

FIG. 12 shows a solvent recovery mechanism according to the present embodiment. As shown in FIG. 12, during printing, the solvent absorbing roller 842 is located in the position indicated by the broken lines in FIG. 12, and it absorbs the solvent 40 from the transfer belt 16. When the solvent in the solvent absorbing roller 842 is to be recovered, the solvent absorbing roller 842 is moved, by a solvent absorbing roller movement device (not shown in the drawings), to a solvent suctioning position located to the side of the conveyance path of the transfer belt 16, where an opening section 846 is placed in contact with the surface of the solvent absorbing roller 842 and the solvent is suctioned and recovered by operating a pump (not shown in FIG. 12).

In this way, in the present embodiment, the solvent is recovered in the off line state, and therefore the solvent absorbing roller 842 is not subjected to excessive load when absorbing the solvent 40 on the transfer belt 16.

A transfer belt is used as the intermediate transfer medium in the embodiments described above, but the intermediate transfer medium according to the present invention is not limited to a transfer belt, and it may also be an intermediate transfer drum. Moreover, the present invention does not only apply to the recording of images onto an intermediate transfer medium, and it may also be applied to an image forming apparatus which records an image directly onto a recording medium.

Image forming apparatuses according to the present invention are described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus for applying a liquid on a medium to form an image, comprising:

a liquid absorbing member which absorbs, through an outer surface thereof, at least a portion of the liquid applied on the medium; and a liquid recovery device which is a separate member from the liquid absorbing member, and suctions and recovers the liquid absorbed in the liquid absorbing member while being in contact with the outer surface of the liquid absorbing member.

2. The image forming apparatus as defined in claim 1, wherein:

the liquid recovery device includes a suction opening section through which the liquid absorbed in the liquid absorbing member is suctioned while the liquid recovery device is in contact with the liquid absorbing member; and the suction opening section has a length shorter than the liquid absorbing member in terms of a lengthwise direction of the liquid absorbing member, and is movable in the lengthwise direction of the liquid absorbing member.

3. The image forming apparatus as defined in claim 1, wherein the liquid recovery device includes a plurality of suction openings through which the liquid absorbed in the liquid absorbing member is suctioned while the liquid recovery device is in contact with the liquid absorbing member, and which are arranged in a lengthwise direction of the liquid absorbing member.

4. The image forming apparatus as defined in claim 1, wherein the medium is a recording medium.

5. The image forming apparatus as defined in claim 1, wherein the medium is an intermediate transfer medium.

6. The image forming apparatus as defined in claim 5, wherein the liquid absorbing member has a surface energy greater than a surface energy of the intermediate transfer medium.

7. The image forming apparatus as defined in claim 1, wherein the liquid absorbing member includes an internal part and an exterior part which forms an exterior surface and has a surface energy greater than a surface energy of the internal part.

8. The image forming apparatus as defined in claim 1, wherein the liquid recovery device suctions and recovers the liquid absorbed in the liquid absorbing member, after a prescribed amount of the liquid is given to the liquid absorbing member.

9. The image forming apparatus as defined in claim 1, wherein the liquid recovery device suctions and recovers the liquid absorbed in the liquid absorbing member in such a manner that a prescribed amount of the liquid is left on the liquid absorbing member.

10. The image forming apparatus as defined in claim 1, wherein the liquid absorbing member is withdrawn from a position for absorbing the liquid applied on the medium when the liquid recovery device suctions and recovers the liquid absorbed in the liquid absorbing member.

* * * * *